United States Patent [19]

Michel

[11] 3,939,805

[45] Feb. 24, 1976

[54] STEAM GENERATOR

[75] Inventor: Eberhard Michel, Nurnberg, Germany

[73] Assignee: Kraftwerk Union Aktiengesellschaft, Mulheim, Germany

[22] Filed: Nov. 26, 1974

[21] Appl. No.: 527,349

[30] Foreign Application Priority Data

Nov. 26, 1973 Germany ..... 2358830

[52] U.S. Cl. ..... 122/32; 165/163

[51] Int. Cl.[2] ..... F22B 1/06

[58] Field of Search ..... 122/32, 33, 34; 165/158, 165/159, 163

[56] References Cited

UNITED STATES PATENTS

| | | | |
|---|---|---|---|
| 3,706,301 | 12/1972 | Penfield, Jr. | 122/32 |
| 3,719,172 | 3/1973 | Charcharos et al. | 122/32 |
| 3,766,892 | 10/1973 | Webster | 122/32 |
| 3,807,365 | 4/1974 | Lyman et al. | 122/32 |

*Primary Examiner*—Kenneth W. Sprague
*Attorney, Agent, or Firm*—Kenyon & Kenyon Reilly Carr & Chapin

[57] ABSTRACT

A pressurized-water reactor steam generator has a preheater surrounding the cold leg of its U-tube bundle heat exchanger, the preheater discharging being separated by a horizontal partition into upper and lower sections which are each connected with its own feed-water inlet and which respectively discharge the preheated feed water upwardly and downwardly. When the generator is operated under low-load conditions, the feed water supplies are cut off from the two preheater sections, resulting in possible boiling of the water in the preheater because of the lack of circulation through the preheater. To prevent such boiling, means are provided for interconnecting the two preheater sections in series, around the horizontal partition, so that feed water can by thermal action circulate upwardly through the preheater, bypassing its partition, the water entering what would normally be the downwardly discharging outlet of the preheater and going upwardly, bypassing the partition and upwardly through the preheater's upper section so as to be discharged upwardly.

4 Claims, 3 Drawing Figures

STEAM GENERATOR

BACKGROUND OF THE INVENTION

A steam generator of the type often used for a pressurized-water reactor coolant loop, is disclosed by the U.S. Webster Pat. No. 3,766,892, dated Oct. 26, 1973. Such a steam generator has a vertical casing with its bottom closed by a tube plate in which the bottom ends of the hot and cold legs of a U-tube bundle heat exchanger, are mounted, the U-tube bundle being encircled by a shroud having a bottom end spaced above the tube plate and a top mounting water separators. The casing has one or more feed-water inlets and is kept filled with water held at a level such that the water thermally rises within the shroud while vaporizing, flows over the top of the shroud, possibly being water separated from the rising vapor, and flows down a descent space formed between the shroud and the inside of the casing, to then flow inwardly over the tube plate and rise again, thus maintaining a circulation.

The type disclosed by the Webster patent has a preheater formed by a vertical wall extending through the corridor formed between the two legs, and connecting with the inside of the shroud, the shroud being substantially cylindrical and forming a substantially semicylindrical side for the preheater. A horizontal partition divides the preheater into upper and lower sections, the generator's casing having two feed-water inlets respectively connected individually with the two sections at a position adjacent to the partition, both the top and bottom of the preheater having outlets so that incoming feed-water flows after preheating, are discharged downwardly towards the tube plate and upwardly in the direction of the top of the shroud. Baffles in both sections provide sinuous water flows wiping heat from the tubes of the cold leg.

The two feed-water inlets connect with the bottom and top, respectively, of the upper and lower preheater sections, by what is in effect a single arcuate manifold which is itself separated into upper and lower sections by an arcuate horizontal partition into upper and lower sections, the two manifolds feeding through an arcuate series of holes formed through the shroud in each instance and positioned, in each instance, adjacent to the preheater's partition. The preheater and manifold partitions are necessarily positioned in the same or approximately the same planes, and they may be formed by a single appropriately shaped flat plate extending from the preheater and through the shroud and into the manifold.

It can be seen that with the reactor coolant continually circulating through the U-tube bundle, that heat is removed from the cold leg by upwardly and downwardly directed flows of incoming feed water, the water, while in the preheater and flowing, remaining at temperatures which under the steam pressure existing in the generator, avoid boiling of the water. It is desirable to avoid such boiling because it results in operational instabilities, such oscillations in the water circulating in the generator, and, boiling within the preheater throws down concentrations of corrosive products inevitably contained by the feed water.

When the demand for steam produced by this type of steam generator drops or terminates for any reason, and the generator operates under low-load conditions as compared to its normal loading, the demand for the input of feed water correspondingly drops or is eliminated. Under such conditions, it may be necessary to entirely stop the flow of feed water through the two feed-water input connections, and to provide through another and smaller input connection, just enough feed water to maintain the water level in the steam generator as required to maintain the described circulation up within the shroud and down outside the shroud through the descent space between the shroud and casing of the generator.

However, with the normal feed water to the two preheater sections, then terminated, there is no circulation through either section of the preheater and, therefore, the described boiling within the preheater occurs or can occur. The partitions in the preheater and its manifold block thermal upwardly flow through the preheater inside of the shroud.

Now it can be seen that the practical operation of the described type of steam generator, presents a problem when the generator must be operated under low-load conditions.

SUMMARY OF THE INVENTION

The object of the present invention is to solve the above problem and, according to the invention, this is done by providing a means for controllably bypassing the partition in the preheater, to establish a flow path from the lower outlet, or at least the opening that normally functions as such as outlet, up through the preheater's lower section, around the partition and to above its top, and thus interconnect the two sections in series, so that the flow can continue upwardly through the preheater's upper section, following the normal water flow path as to that section. In this way the normal thermo-siphon circulation within the generator, can be used to force a water flow entirely through both sections of the preheater even though their respective feedwater inlets are completely closed.

The preferred mode for effecting such bypassing, is by forming an arcuate series of holes through the manifold's partition and providing an arcuate plate which slides on this partition and has generally corresponding holes, the holes being interspaced so that by sliding the valve plate arcuately, the openings in the manifold's partition can be open and shut.

The manifold partition may be formed by a circular flat ring plate which completely encircles the shroud and is fixed to the inside of the shroud, and the arcuate valve plate also having a corresponding second ring plate that completely encircles the shroud and slides on the first-mentioned ring plate by rotative action. These ring plates must both extend through the ends of the manifolds but this may be done without appreciable misdirection of the feed-water supplied to the manifold.

Throughout the area outside of the manifold, the two ring plates may be provided with openings of such lengths and separated from each other by such small solid plate areas, as to always be more or less registered and, therefore, permitting the downward flow of the water in the descent space not more or less closed by the arcuate manifold.

When the upper ring plate is slid to close the openings in the manifold's partition, the operation of the steam generator proceeds in its normal manner, the feed-water flow through the two preheater sections avoiding any possibility of boiling. Under low-loading conditions, by rotation of the upper ring plate to register its openings with those formed in the manifold partition, the bypassing around the preheater's partition so that upward water circulation through both preheater sections in series, is established to prevent the boiling within the preheater.

BRIEF DESCRIPTION OF THE DRAWINGS

The foregoing is illustrated by the accompanying drawings in which.

DETAILED DESCRIPTION OF THE INVENTION

Figure 1:
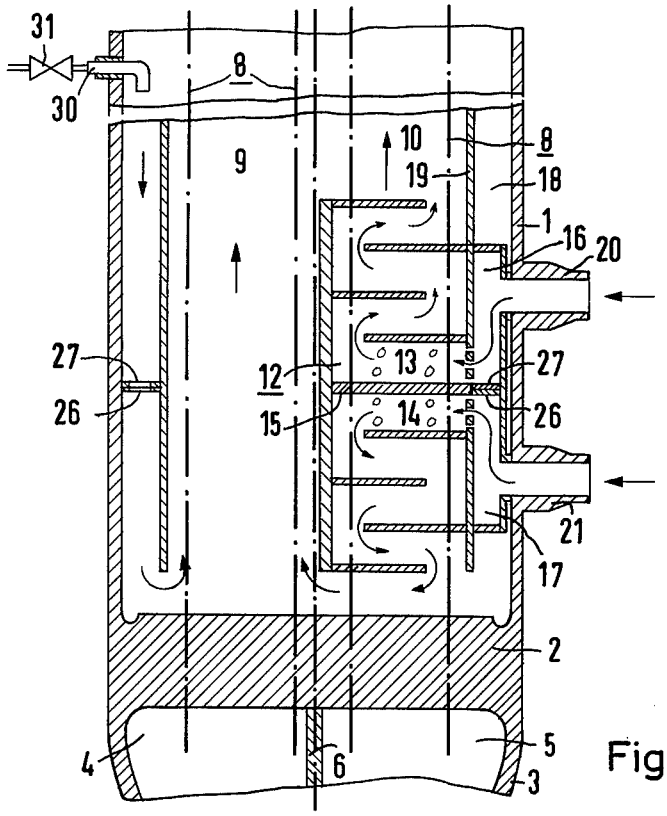
FIG. 1 is a vertical section mainly showing only the lower portion of the steam generator with the section taken through the preheater, this view showing the generator operating normally or under its rated load.

In the above drawings the vertical cylindrical steam generator casing 1 has its lower portion closed by the horizontal tube plate 2 below which the casing's primary header 3 forms a pressurized-coolant inlet chamber 4 and outlet chamber 5, the two chambers being separated by the partition 6. The U-tube bundle 8 is indicated by broken lines, the hot leg being shown at 9 and the cold leg at 10.

Used as the part of a coolant loop of a pressurized-water reactor, the hot coolant, directly from the reactor, enters the chamber 4, goes up through the hot leg 9 and around the tube bends (not shown) and down through the cold leg 10, the chamber 5 connecting with the part of the loop that returns the coolant, now somewhat cooled, to the reactor.

The feed-water preheater 12 has the two flow paths, indicated by the arrows 13 and 14, separated from each other by the horizontal partition 15 which divides the preheater into the upper and lower sections. The descent space 18 is formed around the cylindrical shroud 19 which is radially spaced from the inside of the casing 1, and it is this cylindrical shroud that in an approximately semicylindrical fashion forms the outer side wall of the preheater. The baffles and top and bottom end walls and the vertical flat back wall, are illustrated but not numbered because they may follow the prior art construction. The two sections 16 and 17 of the arcuate manifold are individually supplied with feed water, respectively through the upper feed-water nozzle 20 and the lower feed-water nozzle 12.

The partition of the arcuate manifold is formed by the bottom ring plate 26 which encircles the cylindrical shroud 19 and the upper rotative ring plate 27, these rings plates being in the plane of the horizontal partition 15 of the preheater. When the two rings are in their closed relationship throughout the area of the manifold, this manifold is divided into its usual upper and lower sections, respectively feeding the preheater with the feed water from the nozzle 20 and 21, in the direction of the flow path indicated by the arrows 13 and 14 in FIG. 1. For the reason previouly explained, on the other side the normal descent flow, indicated by the arrow 18a is normal, the generator operating in its normal fashion.

Figure 2:
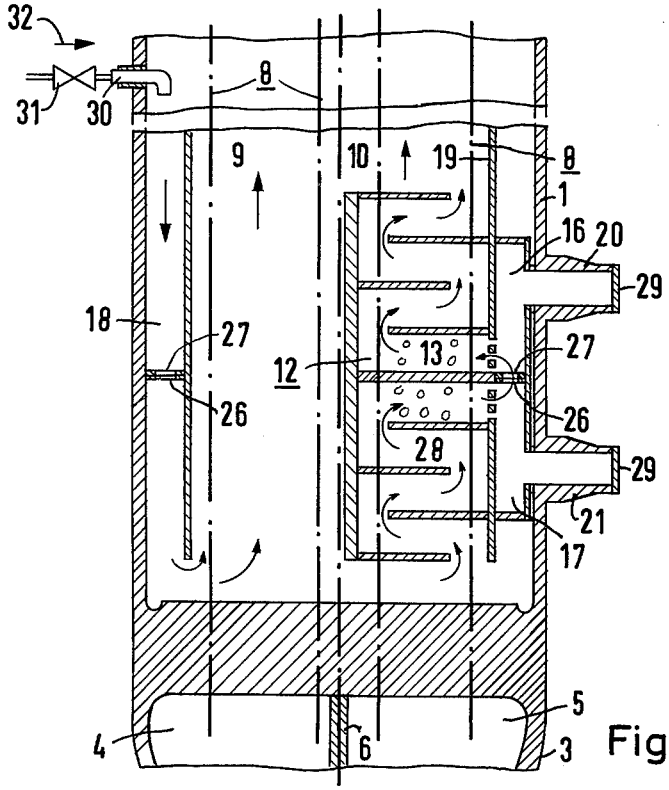
FIG. 2 is the same as FIG. 1 but shows the bypassing action during low-load operation, the two feed-water inlet nozzles being blocked.

Under low-load conditions, as shown by FIG. 2, the plate 27 is rotated to effect the bypassing, the thermally induced flow, as indicated by the arrows 28, then being reversely and upwardly through the lower section of the preheater below the partition 15, and out through what would normally be the inlet openings, but now being a reverse flow, into the lower manifold section, upwardly through the now open manifold partition, and then proceeding through the normal flow path indicated by the arrows 13. Under such conditions there need be no feed-water input through the end of the nozzles 20 and 21, as indicated in FIG. 2 by these nozzles being closed by plugs 29.

Figure 3:
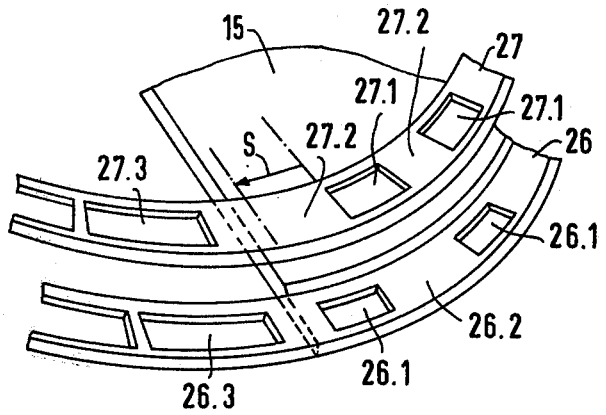
FIG. 3 is an exploded perspective view showing the two ring plates which provide for the described bypassing through the manifold.

Because the U-tube bundle remains heated by the pressurized-water coolant flow, it is necessary to maintain the water level in the casing 1, this being done through an inlet 30 provided with a valve 31, in the upper portion of the casing 1. The general construction of the two ring plates is illustrated in more detail by FIG. 3.

As shown, the lower ring plate 26 slides on an extension of the preheater's partition 15, this being within the arcuate manifold, and has the rectangular cutouts 26.1 arranged as an arcuate series and separated by relative extensive solid portions 26.2, the portion of the plate 26 extending outside of the preheater manifold and around within the descent space, having arcuately longer openings 26.3 separated from each other by solid portions that are only extensive enough to provide structural strength. The upper ring plate 27 which rotates on the lower ring plate 26 has the arcuate series of rectangular openings 27.1 with these openings separated from each other by somewhat less extensive solid portions 27.2, as compared to the solid portions 26.2. The pitch of the holes 26.1 and 27.1 are substantially equal. The solid portions 27.2 can completely cover the holes 26.1 as indicated at S, to effect the closing, rotation of the ring plate 27 effecting registration of the holes 27.1 and 26.1 to effect the opened position. Outside of the manifold, the holes 27.3 in the ring plate 27, and the holes 26.3 in the ring plate 26 are so arcuately extensive and closely interspaced, that they can never close regardless of rotation of the plate 27.

Although not shown, it is to be understood that the rotation of the upper ring plate 27 can be effected by remote controlled equipment, operated from outside of the steam generator. Normally, the inlet nozzles 20 and 21 are supplied by feed-water lines, operating under adequate pressure, through controllable valves which may be adjusted to adjust the upward and downward flows through the preheater, when the generator is operating normally. When these valves are completely closed, the inlet nozzles 20 and 21 are, in effect, plugged, it being for this reason that the plugs 29 are shown in FIG. 2. Other details required by the complete steam generator are disclosed by the previously referred to U.S. Webster patent and the disclosure of that patent is to be considered as incorporated into the present disclosure insofar as concerns details such as the water separators, the steam dome with its steam output outlet above the water separators, and the like.

I claim: What is claimed is:

1. A steam generator comprising an upstanding substantially cylindrical casing having a lower portion and a tube plate closing said portion, a U-tube bundle in said casing and having hot and cold legs mounted in said plate, means for flowing primary fluid up through said hot leg and down through said cold leg, a substantially cylindrical shroud encircling said bundle and forming a descent space therearound inside of said casing and opening to the inside of the shroud adjacently above said tube plate, a feed-water preheater enclosing a lower portion of said cold leg and having upper and lower outlets separated by a partition normally closing the preheater against through-flow by way of said outlets, said casing having upper and lower feed-water inlets, upper and lower manifold sections respectively connecting said upper and lower inlets with said preheater respectively above and below said partition, means for closing said inlets, and means for controllably bypassing said partition to establish a flow path from said lower outlet through said preheater and out through said upper outlet.

2. The generator of claim 1 in which said upper and lower manifolds are separated by a common partition and said means for bypassing is formed by at least one opening in said manifold's partition and a valve means for controlling flow through said opening.

3. The generator of claim 2 in which said common partition is positioned in substantially the same horizontal plane as is said preheater's partition and said valve is formed by a plate normally covering said opening and having at least one hole which by sliding said plate can be registered with said opening.

4. The generator of claim 3 in which the manifold's said common partition and valve is formed by a portion of superimposed flat ring plates horizontally encircling said shroud, said ring plates being relatively rotative and having openings forming said at least one opening and mutually positioned to be opened and closed by relative rotation of said ring plates, said ring plates extending through said manifolds and outside of the manifold having openings which remain at least partially registered regardless of said relative rotation.

* * * * *